US009587424B2

(12) United States Patent
Svenson

(10) Patent No.: US 9,587,424 B2
(45) Date of Patent: Mar. 7, 2017

(54) POST FOR A FOLDING DOOR

(71) Applicant: Julian Michael Svenson, Cornwall (CA)

(72) Inventor: Julian Michael Svenson, Cornwall (CA)

(73) Assignee: Dynamic Closures Corporation, Long Sault, Ontario (CA)

( * ) Notice: Subject to any disclaimer, the term of this patent is extended or adjusted under 35 U.S.C. 154(b) by 0 days.

(21) Appl. No.: 14/544,829

(22) Filed: Feb. 24, 2015

(65) Prior Publication Data

US 2016/0017651 A1 Jan. 21, 2016

(30) Foreign Application Priority Data

Jul. 21, 2014 (CA) ..... 2857149

(51) Int. Cl.

| | |
|---|---|
| ***E06B 3/48*** | (2006.01) |
| ***E04B 2/78*** | (2006.01) |
| ***E06B 1/52*** | (2006.01) |
| ***E04B 2/76*** | (2006.01) |
| *E04B 2/02* | (2006.01) |
| *E05B 65/00* | (2006.01) |
| *E06B 3/94* | (2006.01) |

(52) U.S. Cl.

CPC ..... *E06B 3/481* (2013.01); *E04B 2/76* (2013.01); *E04B 2/7836* (2013.01); *E04B 2/7872* (2013.01); *E06B 1/52* (2013.01); *E04B 2002/0258* (2013.01); *E05B 65/0085* (2013.01); *E06B 3/94* (2013.01)

(58) Field of Classification Search

CPC ... E06B 1/52; E06B 3/481; E06B 3/94; E05B 65/0085; E04B 2/76; E04B 2/7818; E04B 2/7836; E04B 2/7872; E04B 2002/0258

USPC ..... 52/843, 204.1, 243.1, 780, 781, 802.1, 52/207, 127.5, 716.8, 844, 845, 125.2, 52/125.3; 49/365; 160/199, 206

See application file for complete search history.

(56) References Cited

U.S. PATENT DOCUMENTS 799,320 A * 9/1905 Franks ..... F16L 9/22 138/154
1,608,100 A * 11/1926 Hart ..... E04H 1/1266 52/239
1,834,710 A * 12/1931 Jones ..... E04B 2/7818 52/464
1,854,324 A * 4/1932 Anderberg ..... E04B 2/42 52/125.3
2,013,763 A * 9/1935 Olsen ..... E04B 2/78 52/282.2
2,017,441 A * 10/1935 Kotrbaty ..... E04B 1/14 52/404.1
2,032,922 A * 3/1936 Driver ..... E04B 2/7809 52/481.2

(Continued)

*Primary Examiner* — Robert Canfield
(74) *Attorney, Agent, or Firm* — George A. Seaby

(57) ABSTRACT

A locking post for a closure, the post having front and rear walls joined at their sides by two side walls to form a tubular post having a generally quadratic cross-sectional shape. Each side wall has a groove therein, the groove parallel to the longitudinal axis of the post, and wide enough and deep enough to at least partly receive a locking element carried by the post. The sides of the groove also provide handles which can be gripped to move a closure the post is mounted on.

2 Claims, 4 Drawing Sheets

(56) References Cited

U.S. PATENT DOCUMENTS 2,277,792 A * 3/1942 Small ..... E04B 2/7818 52/506.09
2,976,969 A * 3/1961 Gillespie ..... E04B 2/967 52/204.591
3,023,859 A * 3/1962 Muessel ..... E04B 2/967 138/106
3,134,468 A 5/1964 Toti et al.
3,282,006 A * 11/1966 Halsey ..... E04B 2/76 403/384
3,363,390 A * 1/1968 Crane ..... E06B 3/22 108/43
3,396,499 A * 8/1968 Biffani ..... E04B 1/2403 52/127.12
3,416,282 A * 12/1968 Daugherty ..... A47B 95/04 428/122
3,563,068 A 2/1971 Dushane, Jr.
3,699,734 A * 10/1972 Craig ..... E04B 2/82 52/127.6
3,740,979 A * 6/1973 Crepinsek ..... E05B 63/0013 292/207
3,827,183 A * 8/1974 Zimmerman ..... E06B 7/2318 16/412
3,874,135 A * 4/1975 Craven ..... E06B 3/68 52/656.6
4,069,638 A * 1/1978 Hasselqvist ..... B21C 37/104 403/231
4,192,119 A 3/1980 Murphy
4,383,397 A * 5/1983 Ward ..... F16B 12/02 403/188
4,383,569 A * 5/1983 Labelle ..... E05B 65/0085 160/116
4,663,950 A * 5/1987 Mascotte ..... E05B 63/0013 70/135
4,712,286 A * 12/1987 Wolf ..... A47B 57/40 138/160
D296,242 S * 6/1988 Sperr ..... D25/122
D306,078 S * 2/1990 Whitney ..... D25/119
5,095,678 A * 3/1992 Murphy ..... E04C 3/07 52/844
5,099,903 A * 3/1992 Chen ..... E05D 15/266 160/199
5,211,502 A * 5/1993 Upham-Hill ..... E04B 2/7425 160/229.1
5,269,619 A * 12/1993 Warkus ..... F16B 7/0473 403/20
5,271,204 A * 12/1993 Wolf ..... A47B 96/1458 52/836
5,622,065 A * 4/1997 Persiano ..... E05B 9/08 292/195
6,296,038 B1 * 10/2001 Chen ..... E06B 3/481 160/118
6,519,911 B1 2/2003 Sawada
6,915,616 B2 * 7/2005 Fontana ..... H05K 7/183 312/265.1
7,096,641 B2 * 8/2006 Birnbaum ..... E04C 3/07 428/595
8,366,340 B2 * 2/2013 Munakata ..... E04B 2/766 403/231
9,347,213 B1 * 5/2016 Zhang ..... E04B 1/40
2003/0024179 A1 * 2/2003 Cates ..... E04B 2/7457 52/204.1
2003/0159397 A1 * 8/2003 Birnbaum ..... E04C 3/07 52/843
2004/0168382 A1 * 9/2004 Rudduck ..... A47B 91/02 52/238.1
2005/0034414 A1 * 2/2005 Unverzagt ..... E04C 3/07 52/843
2005/0129458 A1 * 6/2005 Hoffmann ..... F16B 7/187 403/256
2014/0283481 A1 * 9/2014 Zhang ..... F16B 37/0885 52/843
2016/0017652 A1 * 1/2016 Svenson ..... E06B 3/48 52/844

* cited by examiner

POST FOR A FOLDING DOOR

BACKGROUND OF THE INVENTION

1. Technical Field

This invention relates to a tubular post for a closure, and particularly to a tubular locking post.

2. Background Art

Tubular posts for closures, and particularly tubular locking posts for folding doors, are known. The posts have a quadratic cross-sectional shape with opposed front and rear walls and opposed side walls joining the front and rear walls together. The post has a lock mechanism mounted within it with a latch operable from within the post to extend outwardly from the front wall of the post to fasten or lock the folding door to the side of an opening closed by the door. The lock mechanism usually has a lock element, such as the cylinder of a cylinder lock, projecting out from a side wall of the post so that the lock is accessible. The post will also have a handle on each side wall to be able to move the post and thus the folding door the post is a part of. The cylinder and the handles project laterally from the post and can interfere with people passing by. The cylinder and handle can also be damaged by contact with a hard object such as a large piece of furniture, or a large container, being moved past the door.

SUMMARY OF THE INVENTION

A tubular locking post is provided with front and rear walls joined with two side walls. Each side wall has a relatively deep and wide central groove therein extending over at least a substantial, and preferably entire, length of the post.

In one aspect, the groove in the side wall is an external groove that extends inwardly toward the other side wall. Any locking elements projecting from, or on, the side wall of the post are located within the groove to be protected. As well, the side walls of the groove provide integral handles on the post to be able to pull the post in either direction.

In another aspect, the groove in each side wall is an internal groove extending outwardly away from the other side wall and forming an external ridge on the side wall. The ridge can protect any locking element projecting from within the post. An opening in the ridge provides access to the element. The sides of the ridge form integral handles on the post for pulling the post in either direction.

DETAILED DESCRIPTION OF THE INVENTION

It is the purpose of the present invention to provide a tubular locking post constructed to protect elements on the locking post which project from the side walls of the post. It is another purpose of the present invention to provide a locking post with integral handles which are less intrusive and thus less liable to be damaged or to inflict damage.

Figure 1:
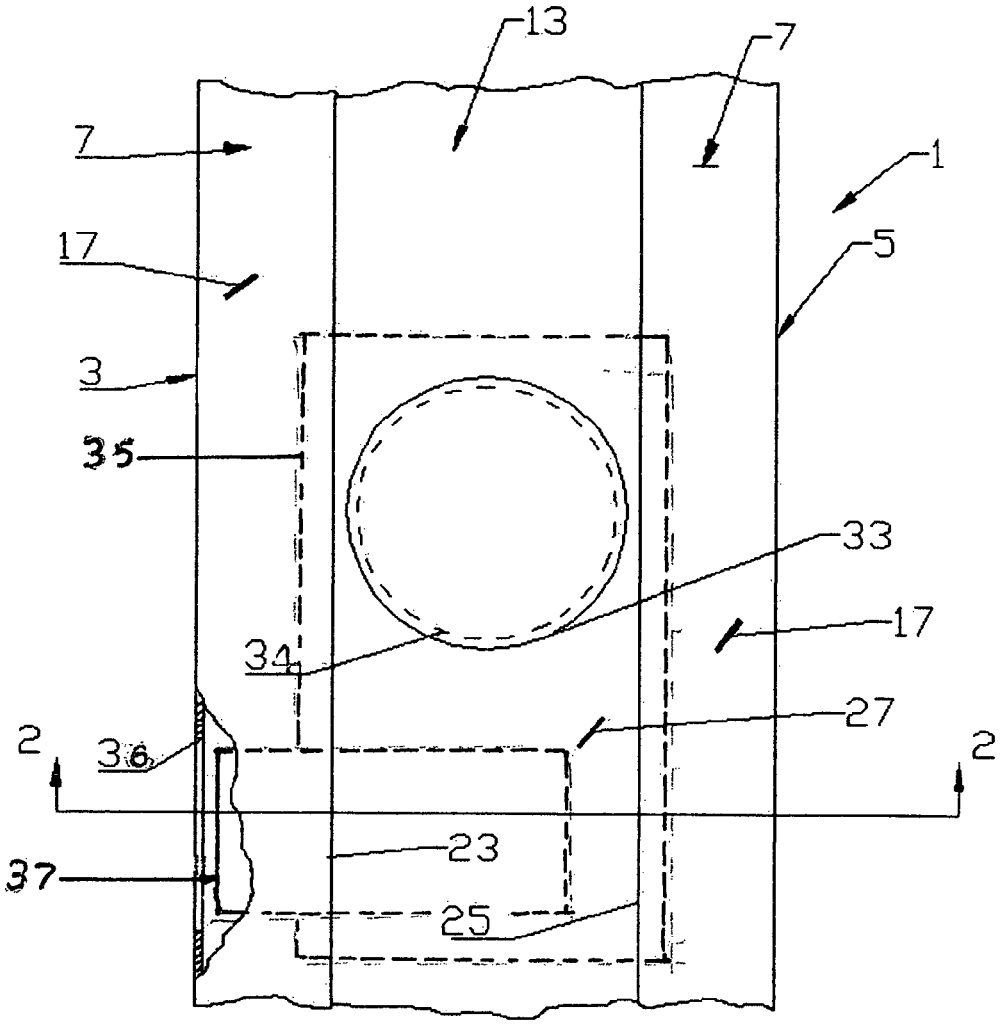
FIG. 1 is a front elevation view, in partial cross-section, of a section of the locking post.
Figure 2:
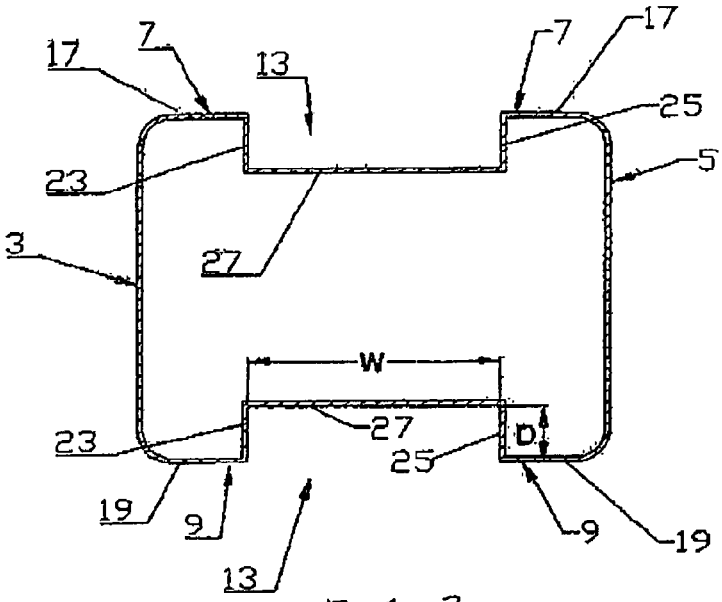
FIG. 2 is a cross section view taken along line 2-2 in FIG. 1.
Figure 3:
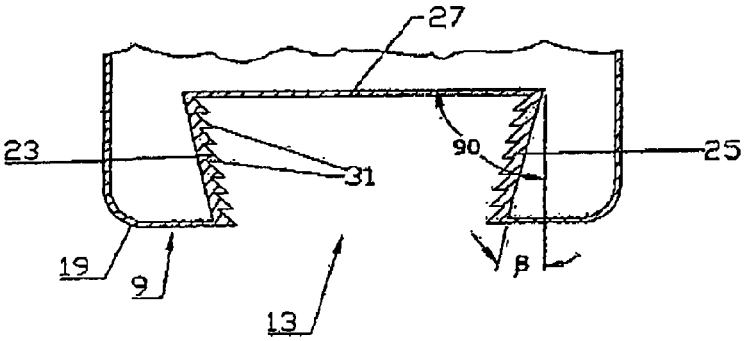
FIG. 3 is a detail cross section view of a modified groove in the post.

An exemplary embodiment of the locking post is described herein. However it is understood that configurations of the various elements may vary The locking post 1, as shown in FIGS. 1-3, is a tubular member having front and rear walls 3, 5 joined, on their sides, by side walls 7, 9. The post 1 has a generally quadratic, cross-sectional shape. The front wall 3 of the locking post 1 is normally the lead wall of the folding door the post is mounted on when the door is being moved to close an opening. The post 1 has a relatively wide, relatively deep, groove 13 in the center of each side wall 7, 9. The groove 13 extends over at least a major portion of the length of the post, and preferably over the entire length of the post, parallel to the longitudinal axis of the post. The groove 13 has a generally rectangular, cross-sectional shape. The groove 13 has a width W, in a direction between the front and rear walls 3, 5, which is substantially greater than the depth D of the groove. The groove 13 is wide enough and deep enough to at least partly receive an element of a locking mechanism carried by the post.

In one embodiment, shown in FIGS. 1-3, the groove 13 in each side wall 7, 9 is an external groove, opening outwardly from the post 1 and extending inwardly into the post toward the other side wall. The groove 13 separates each side wall 7, 9 into two side wall sections 17, 19 respectively. Each groove 13 is defined by groove sides 23, 25 extending inwardly from the inner ends of the side wall sections 17, 19 respectively. The groove sides 23, 25 of each groove 13 extend generally toward the groove sides of the opposite groove 13. The groove sides 23, 25 in each groove are joined by an end side 27 which is parallel to the side wall sections 17, 19.

Each groove 13 is deep enough, at least a half inch deep, so that a person can pull on either groove side 23, 25 of the groove with their fingers to move a folding door the post is mounted on in either direction. The groove sides 23, 25 of the groove form integral handles on the post and eliminate the need for a separate handle mounted on the connecting walls 7, 9. The groove sides 23, 25 of the groove 13 are unlikely to be damaged in a manner that prevents their use as handles in moving the door as might be the case when using projecting, attached, handles. The groove sides 23, 25 also allow the use of two hands to open the door if needed.

The groove sides 23, 25 of each groove 13 can be ribbed as shown in FIG. 3, by longitudinal extending ribs 31 to provide a better grip on the groove sides 23, 25 with the fingers when pulling on the groove sides to open or close the door. Alternatively, or in addition to, the groove sides 23, 25 can be angled slightly in toward each other in moving in a direction from the end side 27 of the groove 13 toward the connecting wall sections 17, 19, as shown by the angle $\beta$, to provide a better grip on the groove sides 23, 25. The angle $\beta$ can be between 5° and 15°.

The groove 13 is also wide enough to accommodate, within the groove, locking cylinders used on locks used in folding doors. The grooves 13 are at least one and a quarter inches in width. At least one of the grooves 13, as shown in FIG. 1 has a cylinder opening 33 in the end side 27 of the groove 13, the opening 33 almost as wide as the end side. The cylinder opening 33 is preferably circular. A locking cylinder 34, shown in part by dash lines in FIG. 2, from a known cylinder lock mechanism 35 within the post 1, can project out of the post, through the cylinder opening 33 in the end side 27 of the groove 13, into the groove. The cylinder 34 will sit in the groove 13 barely projecting above the connecting wall sections 17, 19 and thus will be protected within the groove and be much less likely to be damaged. The groove 13 is also wide and deep enough to accommodate a panic operator such as a handle within the groove. The panic handle operates the lock mechanism on the post in an emergency and is less likely to be operated in error when located within the groove, than if it was in the open.

The post 1 also has a latch opening 36 in the front wall 3, near the cylinder opening 33 but preferably offset from it in the longitudinal direction of the post. The latch opening 36 is preferably rectangular and centered widthwise on the front wall 3. The latch opening allows the latch 37 of the lock mechanism 35 within the post to emerge from the post, when the locking cylinder 34, as a latch operator, is operated. The emerging latch will lock the post to another post or to the side of an opening closed by the folding door as is known.

Figure 4:
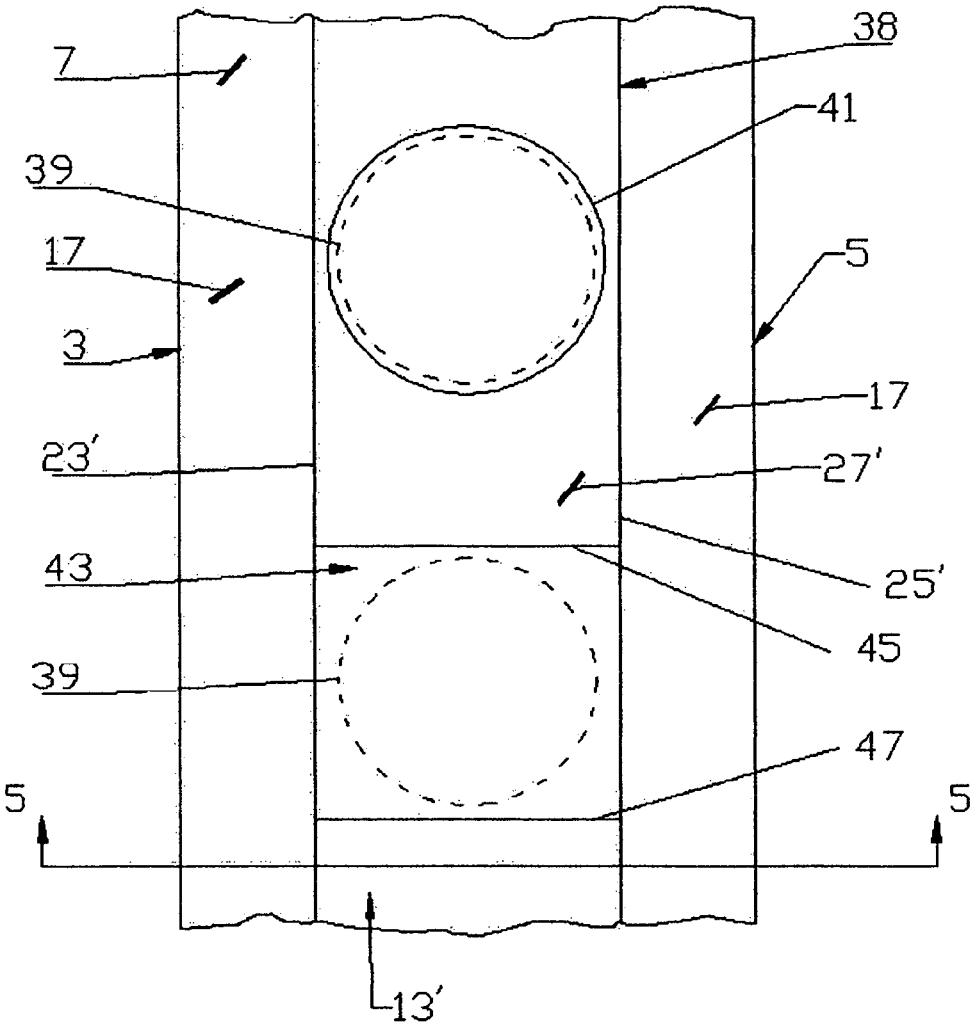
FIG. 4 is a front elevation view of a section of another embodiment of the locking post.
Figure 5:
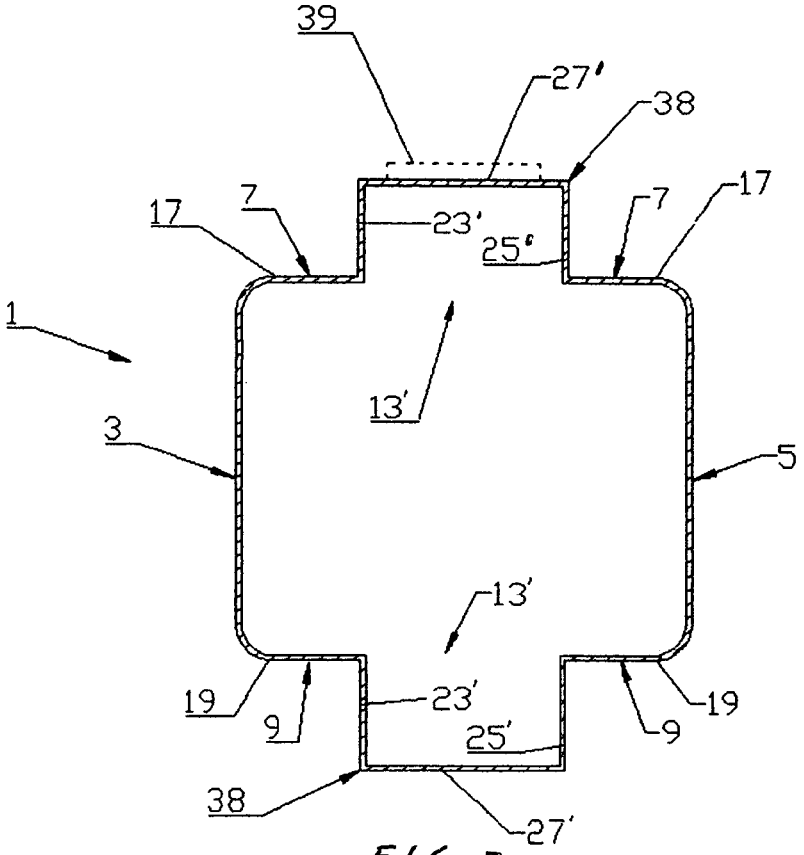
FIG. 5 is a cross-section view taken along line 5-5 in FIG. 4.
Figure 6:
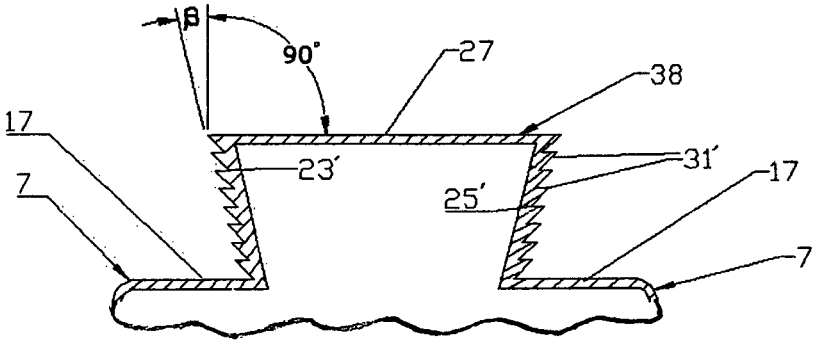
FIG. 6 is a detail, cross-section view of a modified ridge on the post.

In a second embodiment, as shown in FIGS. 4-6, the groove 13' in each side wall 7, 9 is an internal groove, opening to the inside of the tubular member, and extending outwardly away from the other side wall. The groove 13' on each side wall 7, 9 extends over at least a substantial portion of the length of each side wall and preferably its entire length. The groove 13' separates each side wall into two side wall sections 17, 19. Each groove 13' is defined by groove sides 23', 25' extending outwardly from the free ends of the connecting wall sections 17, 19 respectively. The groove sides 23', 25' are joined by an end side 27' which is parallel to the connecting wall sections 17, 19.

The groove sides 23', 25' and the end side 27' form a ridge 38 on each connecting wall 7, 9. The ridge 38 is wide enough and deep enough to receive a lock element, such as a lock cylinder 39, therein. A cylinder opening 41 can be provided in the ridge for the cylinder. The opening 41 can comprise a circular hole in the end side 27' for the cylinder 39 to just project through. Alternatively, the ridge 38 can be cut to remove a section of the ridge to provide a cylinder opening 43 between the cut ends 45, 47 of the ridge for the cylinder 39. The cylinder opening 43 is rectangular in this embodiment, the cylinder 39 projecting just above the ridge 38 between the cut ends 45, 47 and protected by the ridge 38 on either side of the opening 43.

Each ridge 38 is high enough, preferably at least a half inch high, so that a person can grip either groove side 23', 25' of the ridge with their fingers and pull the door in either direction. The groove sides 23', 25' of the ridge 38 form integral handles on the ridge and eliminate the need for seperate handles mounted on the sides of the post.

The groove sides 23', 25' of each ridge 38 can be ribbed as shown in FIG. 6 by longitudinal extending ribs 31' to provide a better grip on the groove sides 23', 25' with the fingers when pulling on either groove side to move the door. Alternatively, or in addition to, the groove sides 23', 25' can each be angled slightly away from each other by an angle β in moving in a direction from the connecting wall sections 17, 19 toward the end side 27' to provide a better grip on the groove sides 23', 25'. The angle β can be between 5° and 15°.

The post 1 in the above embodiment shown in FIGS. 4-6 also has a latch opening (not shown) the same as the latch opening 36 shown in the embodiment of FIGS. 1-3. The latch opening is in the front wall 3 of the post, near the cylinder opening 41 in one of the side walls 7, 9 in the longitudinal direction of the post.

I claim:

1. A tubular locking post for a folding door comprising a front wall, a rear wall and two side walls joining ends of the front and rear walls to form the post with a generally rectangular cross section, a longitudinally extending groove in each side wall defining a handle in said side wall, each groove having a depth of at least one half inch, a pair of side walls spaced apart by at least one and one quarter inches, an inner end wall and an open outer end, wherein the groove side walls are perpendicular to the inner end wall or the groove flares inwardly from the open outer end to the inner end wall for facilitating insertion of a person's fingers into the groove and further comprising longitudinally extending ribs on said groove side walls facilitating gripping of said groove side walls.

2. A tubular locking post as claimed in claim 1 further comprising a circular opening in the end wall of one of the grooves, the opening being sufficiently large to pass a locking cylinder of a cylinder lock used on a locking post from within the post into the groove; and a rectangular opening in the front wall sufficiently close to the circular opening to pass a latch of the cylinder lock from within the post through the front wall of the post.

* * * * *